US009511419B2

(12) United States Patent
Avila et al.

(10) Patent No.: US 9,511,419 B2
(45) Date of Patent: Dec. 6, 2016

(54) IMPACT PAD FOR USE IN TUNDISH OF CONTINUOUS CASTING STEEL

(75) Inventors: Thiago Augusto Avila, Belo Horizonte (BR); Bruno Augusto Batista Ribeiro, Belo Horizonte (BR); Herbert Amarildo Dos Santos, Belo Horizonte (BR)

(73) Assignee: MAGNESITA REFRATARIOS S/A, Contagem, MG (BR)

( * ) Notice: Subject to any disclaimer, the term of this patent is extended or adjusted under 35 U.S.C. 154(b) by 88 days.

(21) Appl. No.: 13/812,746

(22) PCT Filed: Apr. 19, 2011

(86) PCT No.: PCT/BR2011/000114

§ 371 (c)(1),
(2), (4) Date: Apr. 8, 2013

(87) PCT Pub. No.: WO2012/012853

PCT Pub. Date: Feb. 2, 2012

(65) Prior Publication Data

US 2013/0221588 A1 Aug. 29, 2013

(30) Foreign Application Priority Data

Jul. 27, 2010 (BR) ..... PI1002628-2

(51) Int. Cl.
*B22D 41/00* (2006.01)
*B22D 11/10* (2006.01)
*B22D 41/08* (2006.01)

(52) U.S. Cl.
CPC ..... *B22D 41/003* (2013.01); *B22D 11/10* (2013.01); *B22D 41/08* (2013.01)

(58) Field of Classification Search
CPC .... B22D 41/003; B22D 11/10; B22D 41/08; B22D 11/11; B22D 11/118; B22D 7/062
USPC ..... 266/275, 286, 287, 236; 164/335, 337, 164/437, 362; 222/594; 249/206
See application file for complete search history.

(56) References Cited

U.S. PATENT DOCUMENTS 3,887,171 A 6/1975 Neuhaus
4,776,570 A 10/1988 Vo Thanh et al.

(Continued)

FOREIGN PATENT DOCUMENTS

BR PI0800035-2 A2 1/2009
DE 102007035452 A1 1/2009
EP 1232814 A1 8/2002

OTHER PUBLICATIONS

European Office Communication dated Jul. 3, 2014, for EP 11719446.4.

(Continued)

*Primary Examiner* — Scott Kastler
*Assistant Examiner* — Michael Aboagye
(74) *Attorney, Agent, or Firm* — Bacon & Thomas, PLLC

(57) ABSTRACT

An impact pad for use in tundish of continuous casting steel during pouring out of molten steel (6) from the casting ladle into the tundish. The impact pad (1) has side walls (2) provided with barriers (3) distributed spaced apart and staggered in height and in length in the whole extension of the walls (2) or part thereof, the impact pad (1) still comprises an impact bottom (5) provided with corrugations (4) uniformly distributed and staggered in its entirety or part thereof.

24 Claims, 3 Drawing Sheets

(56) References Cited

U.S. PATENT DOCUMENTS

| | | | | |
|---|---|---|---|---|
| 5,131,635 | A * | 7/1992 | Soofi | 266/275 |
| 5,169,591 | A | 12/1992 | Schmidt et al. | |
| 5,188,796 | A * | 2/1993 | Soofi | 266/275 |
| 5,358,551 | A | 10/1994 | Saylor | |
| 5,518,153 | A | 5/1996 | Zacharias et al. | |
| 5,597,528 | A * | 1/1997 | Whaley | 266/100 |
| 6,929,775 | B2 * | 8/2005 | Connors, Sr. | 266/275 |
| 2002/0033567 | A1 * | 3/2002 | Morales et al. | 266/283 |
| 2004/0041312 | A1 | 3/2004 | Connors | |
| 2009/0050285 | A1 | 2/2009 | Barrett | |

OTHER PUBLICATIONS

Joaci Goncalves de Oliveira, Antonio Eli Nunes, Luiz Carlos Lopes, Alessandro Prenazzi, Bruno Augusto Batista Ribeiro, "Development of New Tundish Configuration in Continuous Casting Machine #3 of the Usiminas-Cubatao", Tecnologia em Metalurgia, Materials e Mineracao, 20100727, pp. 3903-3916, 2010; and English translation thereof.

* cited by examiner

IMPACT PAD FOR USE IN TUNDISH OF CONTINUOUS CASTING STEEL

The present invention relates to an impact pad which presents an internal disposition specially developed for damping the stream of molten metal during its pouring out of a ladle to the tundish in continuous casting plants, thus minimizing the turbulence phenomenon, which is harmful to the quality of processed steel.

DESCRIPTION OF PRIOR ART

The continuous casting process is used by nearly 90% of the most important steel plants in the world, due to its low operation costs, reduced energy expenditure and high productivity. A person skilled in the art knows that a turbulent flow within a tundish due to high velocity of the molten metal poured out of the ladle may cause slag and refractory material fragments to be dragged out into the mould, affecting the degree of purity of the processed steel. A skilled technician is aware of splash formation at the beginning of a continuous casting sequence or in ladle change, when a high turbulence zone is formed near the entry jet of molten steel, which may cause oxygen and nitrogen to be incorporated into the steel due to air contact, or even endanger operators due to steel projection.

A usual form to minimize these and other possible problems caused by turbulence is the use of impact pads, which are more or less effective according to their compliance with some theoretical rules regarding fluid flow. In general, impact pads have the purpose of minimizing steel flow turbulence within the tundish, thus increasing time of residence. They are also intended for directing steel flow for the free surface, allowing trapping of inclusions by the slag. Another object is to reduce splash of the entry stream, thus reducing turbulence and consequently oxygen and nitrogen inclusions, as well as enhancing steel purity.

A solution for this problem is presented in document BR0800035-2, which describes a turbulence inhibitor for tundish in continuous casting steel plants, wherein an impact pad is adapted to the internal part of the tundish of continuous casting, minimizing turbulence during pouring out of molten metal from the feed ladle. The internal structure of the impact pad involves a corrugated relief formed by peaks and valleys on the base and on its side walls. This impact pad may have any geometric form, provided that its internal basic configuration is kept. The large surface generated by the corrugations absorbs the kinetic energy of the liquid entering the impact pad.

BRIEF DESCRIPTION OF THE INVENTION

Turbulence is a naturally occurring process in industrial flows. Its main characteristic is the wide variation of pressure, temperature and velocity over time.

Assuming that a laminar flow, that is, without turbulence, has an average velocity $\overline{\upsilon_0}$, the turbulent flow will be characterized by:

$$\upsilon_x = \overline{\upsilon_x} + \upsilon'_x; \quad \text{(i)}$$

wherein the term $\upsilon'_x$ represents the variation of flow velocity over time, which means that velocity $\upsilon_x$ may suffer large or small variations, for more or less than its value. This constant change in the values of a given property is a characteristic of turbulent flows.

The object of the present invention is to reduce flow velocity values and its variations so as to provide a more uniform flow with smaller velocities. In order to achieve such object, the present invention uses, in its favor, the physical characteristics of the flow processes of a given fluid (molten steel) into a particular surface.

A characteristic used by the present invention is the fact that a fluid stream loses velocity when flowing in contact with a rugged surface (that is, the refractory wall of the impact pad of the present invention). The friction between the surface and the flowing fluid reduces velocity by means of the drag force, which imposes resistance to the flow, being that the stronger the drag force, the slower the flow velocity for the same velocity value analyzed.

The drag force is defined by:

$$F_D = \frac{1}{2}\rho\upsilon^2 C_D A; \quad \text{(ii)}$$

Wherein:

$\rho$ is fluid density;

$\upsilon^2$ is fluid velocity squared $C_D$ is the constant that measures the friction coefficient.

A is the area of contact between the solid and the fluid.

Rewriting the equation (ii) and isolating fluid velocity, the formula is the following:

$$v = \sqrt{\frac{2F_D}{\rho C_D A}} \quad \text{(iii)}$$

From equation (iii) it can be seen that, in order to change the velocity value, it would be natural to change the value of the area where the flows passes through, since the other values are constant or difficult to be changed, and $F_D$ is the friction force resulting from flow properties; $\rho$ is fluid density, that is, a property of molten steel, which does not significantly vary to under ingot casting conditions; and $C_D$, the friction coefficient, is a measure related to the geometrical characteristics of the surface where the fluid passes through, which cannot be changed during the process.

The solution proposed by the present invention, as discussed below, shows an increase from 15% to 35% in the superficial area of the impact surface at the bottom of the impact pad. On the side surfaces of the reducer, the increase in the superficial area ranges from 20% to 50%. This increase in area causes the denominator of equation (iii) to increase and consequently to reduce the value of flow velocity.

Another form of energy dissipation used by the present invention, especially on the side walls of the impact pad is the collision between two fluid streams (molten steel) in opposite directions.

The impact pad of the present invention has side walls with spaced and staggered barriers in height and in length in the whole extension of the walls or part thereof. The reducer also has an impact bottom provided with regularly and staggeredly arranged corrugations. In both cases, on the side wall with barriers and on the corrugated impact bottom, there is a considerable increase in the area, as mentioned above, when compared to a corresponding smooth surface.

The presence of a steel flow directed outward or away from the impact zone, as is the case of long inclined valves, may cause localized wear in the refractory lining. This other stat-of-the-art problem is solved by the present invention through its impact surface having corrugations of diffusive characteristics.

When the prior-art impact pads exhibit a smooth impact surface, there may be a preferential path of high-speed jet with associated reduction in the minimum residence time of the steel in the tundish. Thus, there is an increase in the amount of turbulence kinetic energy at the metal-slag interface. The incorporation of an impact surface having diffusive characteristics such as that of the present invention reduces turbulence and eliminates the formation of a preferential flow path (short-circuit) due to its bigger useful area.

The combination of an impact bottom having a corrugated relief with its high capacity of absorbing kinetic energy, and side walls of a turbulence inhibitor with barriers that promote the collision of fluids coming from opposite directions, besides increasing the contact area, provides a considerable advantage over the objects already known from the prior art.

The flow pattern shown within the impact pad according to the present invention is such that the high velocity regions are confined in the impact region of the steel stream, resulting in low velocities at the metal/slag interface. Initially, the steel flow moves upward, and afterwards it moves parallel to the surface, thus facilitating the absorption of slag inclusions.

BRIEF DESCRIPTION OF THE DRAWINGS

The present invention will be, hereinafter, more fully described based on an example depicted in the drawings. The figures show.

DETAILED DESCRIPTION OF THE DRAWINGS

Figure 1:
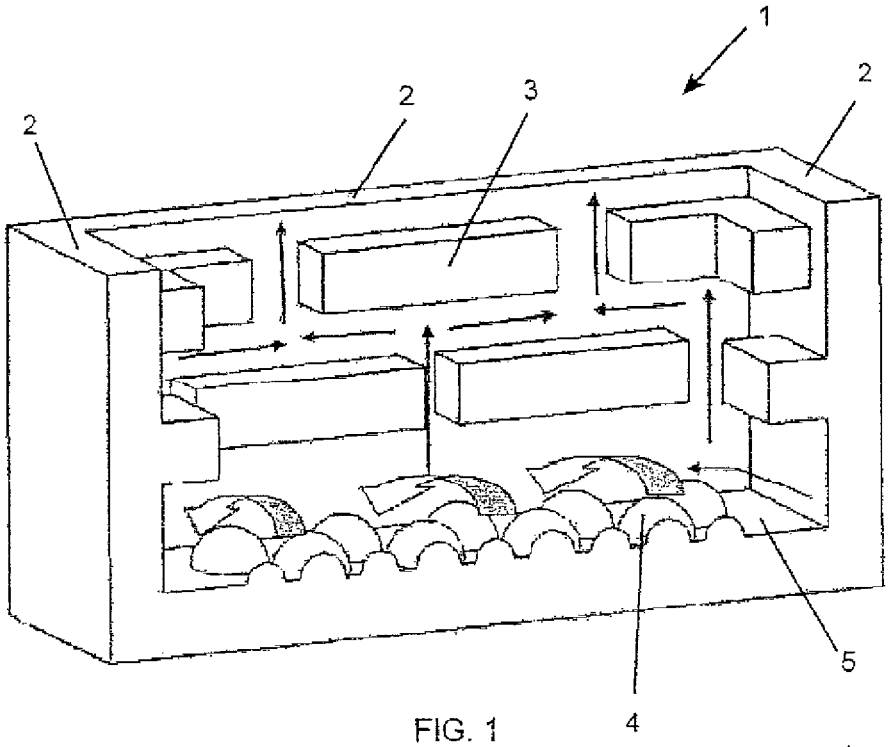
FIG. 1—is a perspective and cross-section view of the object of the present invention.

FIG. 1 shows the impact pad of the present invention in a perspective view with a side cut showing the impact bottom 5 with corrugations 4 and side walls 2 with barriers 3, the impact pad being made of refractory material. Its shape should preferably be rectangular or square and its size should be compatible with the tundish model in which it will be adapted. Other geometric shapes such as circular, hexagonal, octagonal, etc are not beyond the scope of the invention, as long as it is possible to keep its internal basic configuration as shown in FIG. 1. This configuration refers to the composition of multiple barriers 3 of the same material or not of the side walls 2 and that shows in a preferred embodiment the longitudinal section being rectangular, although other types of section may be considered for barriers 3. Said barriers 3 are arranged on the side walls 9 forming a series of obstacles through which part of the flow of molten steel 6 must go by. They may be included in the whole length and height of side walls 2, or only in part of them, and may also vary in the spacing between each other, such definitions depending on the process conditions or other variables.

The rows of barriers 3 ensure the confinement of turbulence to the impact region. The use of two or more rows of barriers 3 ensures the permanence of this confinement effect of turbulence over a longer period of operation in cases of long sequences of casting. The presence of barriers 3, due to its large area, also provides a useful area of optimized incidence of the jet of molten steel, which is of utmost importance in operations of long inclined valves.

In FIG. 1, it can still be seen the impact bottom 5 with corrugations 4. Said corrugations 4 may have different amplitudes and forms depending on process conditions. They may extend throughout the impact bottom 5 or only part of it. They may be, for example, spherical, ovoid and/or disk or plate-shaped. However, they should avoid sharp edges that could harm or detain the flow of liquid steel, thus generating an undesirable dead volume.

Figure 2:
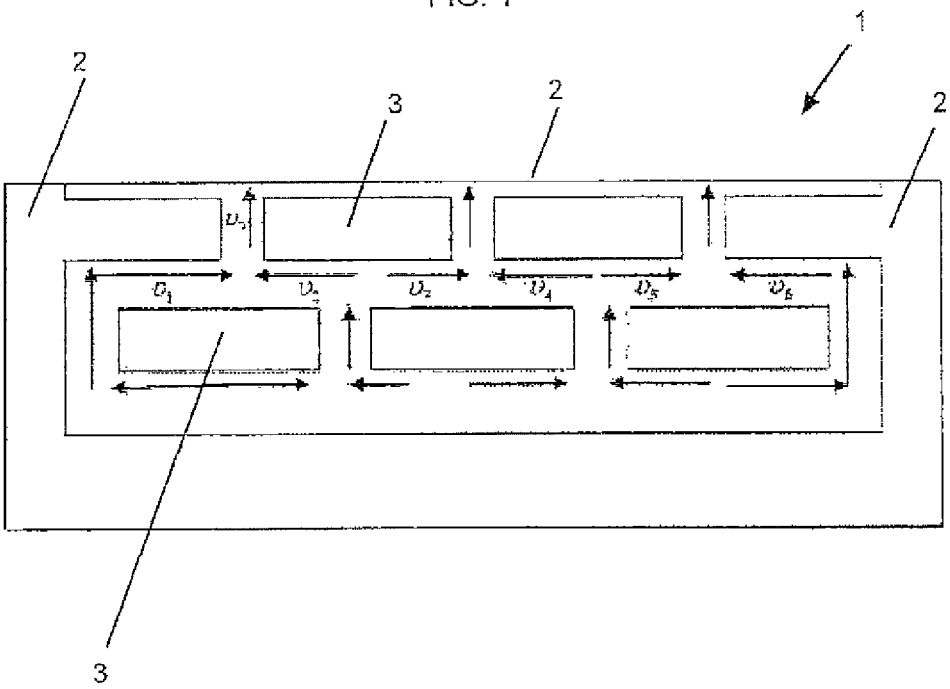
FIG. 2—is the schematic distribution of the fluid flows in the side walls of the object of the present invention.

As can be seen from FIG. 2, the flows indicated by vectors $\upsilon_1$ and $\upsilon_2$ collide between barriers 3 on the side wall 2 of the impact pad of the present invention. This collision causes the horizontal and opposite direction velocities to tend to reduce, in very efficient manner, the resultant final value of the velocity that leaves into the tundish as flow $\upsilon_7$.

Analyzing the flow of molten steel along the walls 2 of the impact pad 1 of the present invention, the large fluid stream entering in impact pad 1 is subdivided into several smaller streams, as shown in FIG. 1. Thus, many small streams are formed and begin to collide with adjacent fluid streams in the opposite direction, between the layers of barriers existing in walls 2 of the impact pad 1 of the present invention. Thus, there is a loss of velocity by the collision of flows of opposite directions associated with the effect of loss of velocity by the friction mentioned above.

Figure 3:
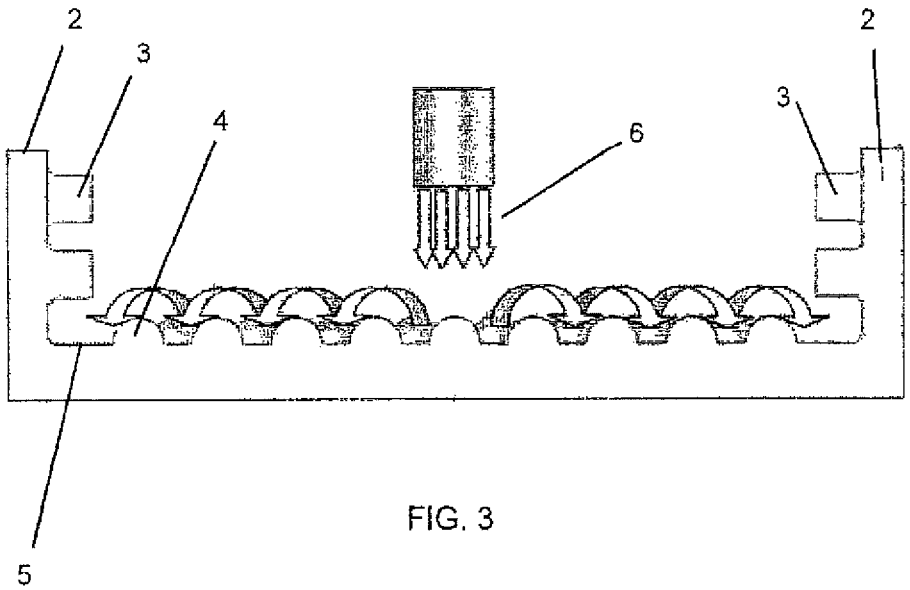
FIG. 3—is a sectional view of the object of the present invention showing the fluid feed.

FIG. 3 shows how the flow of liquid steel 6 is forced to travel a longer way to reach wall 2, by-passing all the corrugations 4 to reach wail 2, and, as mentioned before, the higher the path traveled by the molten steel, the more kinetic energy it dissipates and the lower the turbulence of the flow to the tundish is.

Figure 4:
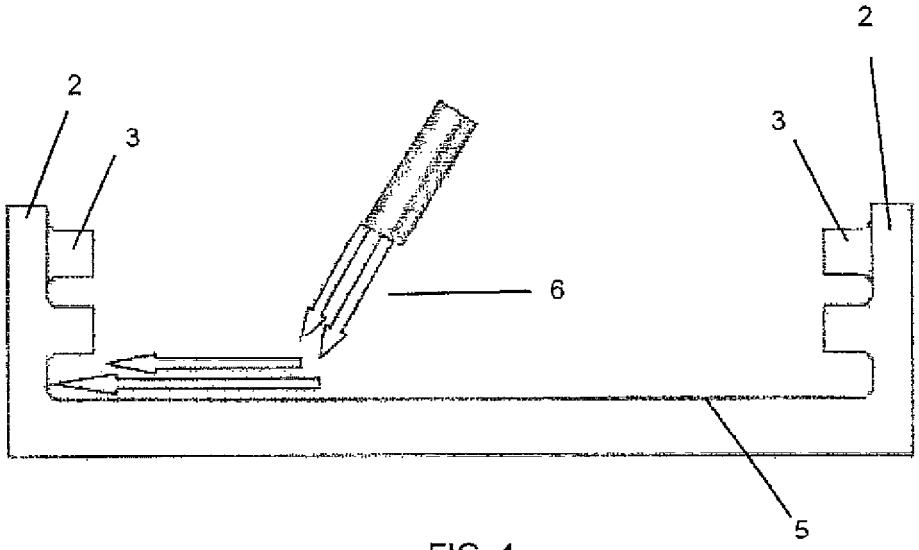
FIG. 4—is a sectional view showing an impact pad with a flat impact surface.
Figure 5:
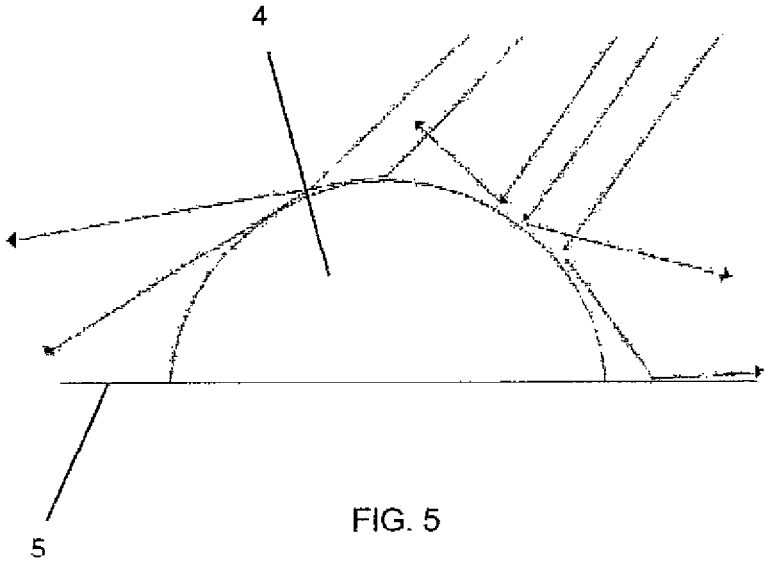
FIG. 5—is a diagram showing the path of the liquid in the corrugated surface.
Figure 6:
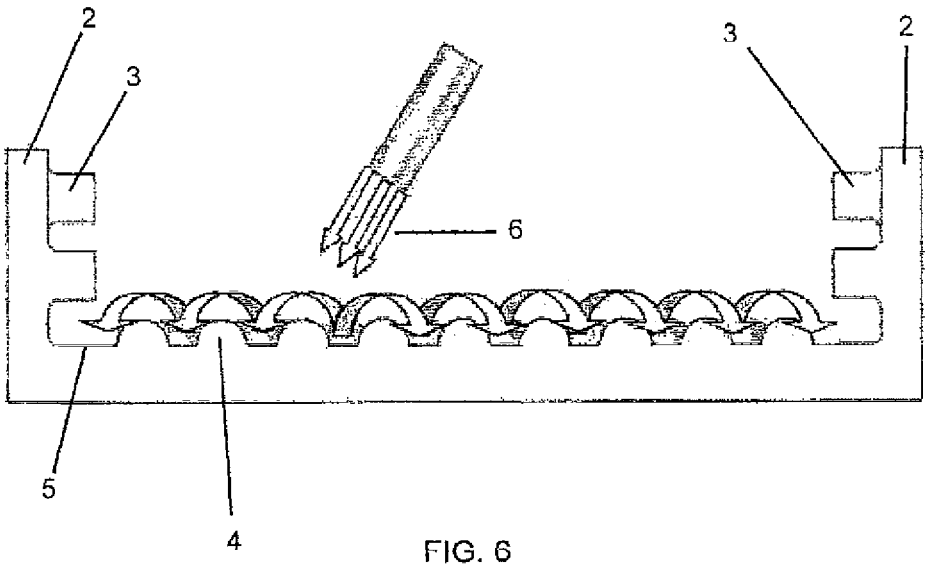
FIG. 6—is a sectional view of the object of the present invention showing an inclined fluid feed.

The present invention also introduces an additional advantage to the flow of molten steel due to its impact surface 5 with corrugations 4 of diffusive characteristics. This impact surface 5 with corrugations 4 is characterized by randomly distribute the flow of steel through the impact pad (see FIG. 5), regardless of the angle of entry of the jet 6, as illustrated in FIG. 6. FIG. 4 shows how the flow would be if the impact pad of the present invention were made with a flat impact surface 5, that is, without corrugations 4. The flat surface deflects the jet of molten steel 6, towards the 2 of the impact pad with virtually no loss of kinetic energy. FIG. 6 shows how the impact pad of the present invention, with the impact surface 5 with corrugations 4, achieves to keep a random distribution of the flow regardless of the angle of entry of jet 6. This causes the molten steel to be better distributed within the impact pad, increasing its efficiency in reducing the kinetic energy of the jet of molten steel 6.

According to the figures mentioned above, we can summarize that the jet of molten steel 6 from the casting ladle is poured out from the upper side into the recipient of the impact pad 1 that is properly fitted inside the tundish. The recipient of the impact pad 1, receives in its impact bottom 5 the impact caused by the intensity of the jet of molten steel 6 which varies depending on the volume of molten steel contained in the ladle. In this process, the level of turbulence generated during pouring out will be proportional to the kinetic energy contained in the jet of molten steel 6. The absorption of part of this energy and consequent reduction of turbulence by the impact pad 1 of the present invention is due to the fact that the jet of steel 6, after reaching the impact bottom 5 with the corrugations 4 of diffusive characteristics, has its flow distributed uniformly with a reduction of kinetic energy due to the large area and consequent high friction, subsequently going against the side walls 2. On the side walls, part of this jet 6 is forced to pass through obstacles formed by barriers 3, thus reducing their movement speed inside the recipient due to the collision of partial flows in the opposite direction and to the wall friction. Barriers 3 also generate a large useful contact area with respective high friction and kinetic energy absorption. As a result, the let of molten steel 6 to the tundish and, then, to the outlet nozzle of the casting mold, occurs with a softened laminar flow, thus avoiding the problems described initially related to oxygen and nitrogen inclusions, slag purging and refractory impairing steel purity.

The invention has been described with reference to a preferred embodiment. It should be construed that the scope of the present invention includes all other possible variations, being limited solely by the content of the appended claims, including possible equivalents therein.

The invention claimed is:

1. An impact pad for use in tundish of continuous casting of steel during pouring out of molten steel from a casting ladle into the tundish, the impact pad comprising:

side walls provided with barriers distributed spaced apart and staggered in height and in length in the whole extension of the walls or part thereof, wherein the barriers have a rectangular shape and are spaced on the side walls so that an offset distribution in two or more adjacent rows of the barriers eliminate the formation of preferential flow paths of the molten steel, and wherein the barriers are configured in a way so that multiple streams of the molten steel are formed to flow between the barriers, and the impact pad also comprising an impact bottom provided with corrugations distributed and staggered in its entirety or part thereof.

2. Impact pad according to claim 1, characterized in that the impact pad is made of refractory material.

3. Impact pad according to claim 1, characterized in that the barriers are made of the same refractory material of the impact pad and have a rectangular cross section.

4. Impact pad according to claim 1, characterized in that the barriers are arranged in at least two rows inside the impact pad.

5. Impact pad according to claim 1, characterized in that the corrugations with diffusive characteristics are spherical, ovoid, disk or plate-shaped, without sharp edges.

6. The impact pad according to claim 1, wherein the barriers promote the collision of fluids.

7. The impact pad according to claim 1, wherein the corrugations have diffusive characteristics and are spherical without sharp edges.

8. The impact pad according to claim 1, wherein the corrugations have diffusive characteristics and are ovoid without sharp edges.

9. The impact pad according to claim 1, wherein the corrugations have diffusive characteristics and are disk-shaped without sharp edges.

10. The impact pad according to claim 1, wherein the corrugations have diffusive characteristics and are plate-shaped without sharp edges.

11. The impact pad according to claim 1, wherein the corrugations have diffusive characteristics and are without sharp edges.

12. The impact pad according to claim 1, wherein at least one of the barriers is located in a corner connected to adjacent side walls.

13. The impact pad according to claim 12, wherein the at least one barrier located in the corner is substantially L-shaped.

14. The impact pad according to claim 1, wherein the barriers are staggered on the side walls in a way so that a horizontal flow of the molten steel in opposite directions collide to reduce the velocity of a vertical flow of molten steel that leaves into the tundish.

15. The impact pad according to claim 1, wherein the barriers vary in the spacing between each other.

16. The impact pad according to claim 1, wherein the corrugations have different amplitudes and forms.

17. The impact pad according to claim 1, wherein the rectangular barriers protrude from the side walls.

18. An impact pad for use in casting of molten metal comprising a first side wall and second side wall meeting in a first corner, and a first rectangular barrier and a second rectangular barrier in a first row, and a third rectangular barrier and a fourth rectangular barrier in a second row below said first row, wherein said third rectangular barrier and said rectangular fourth barrier are configured to form a first obstacle that forces said molten metal to flow between said third rectangular barrier and said fourth rectangular barrier and further flow into the underside of said first rectangular barrier, and wherein each of said rectangular barriers protrude from the side walls having edges that are configured to confine a turbulence in a flow of the molten metal to an impact region.

19. The impact pad of claim 18, wherein each of said rectangular barriers has a longitudinal section being rectangular.

20. The impact pad of claim 18, further comprising an impact bottom provided with regularly and staggeredly arranged corrugations.

21. The impact pad of claim 20, wherein said corrugations show an increase from 15% to 35% in a superficial area of an impact surface at a bottom of the impact pad.

22. The impact pad of claim 20, wherein said rectangular barriers show an increase of from 20% to 50% in a superficial area of said side walls.

23. The impact pad of claim 21, wherein said rectangular barriers show an increase of from 20% to 50% in a superficial area of said side walls.

24. An impact pad for use in casting of molten metal comprising a first side wall and second side wall meeting in a first corner, and a first rectangular barrier and a second rectangular barrier in a first row, and a third rectangular barrier and a fourth rectangular barrier in a second row below said first row, wherein said third rectangular barrier and said fourth rectangular barrier are configured to form a first obstacle that forces said molten metal to flow between said third rectangular barrier and said fourth rectangular barrier and further flow into the underside of said first rectangular barrier, and wherein each of said barriers protrude from the side walls having edges that are configured to confine a turbulence in a flow of the molten metal to an impact region, wherein said first barrier is in said first corner, and said impact pad further comprises a third side wall meeting said second side wall in a second corner, a fourth side wall meeting said third side wall in a third corner, a fifth rectangular barrier in said first row in said second corner, a sixth rectangular barrier in said first row in said third corner, and a seventh rectangular barrier and an eighth rectangular barrier in said second row, wherein said seventh rectangular barrier and said eighth rectangular barrier are configured to form a second obstacle that forces said molten metal to flow between said seventh rectangular barrier and said eighth rectangular barrier and further flow into the underside of said fifth rectangular barrier, and said impact pad further comprises a bottom with a plurality of corrugations wherein said corrugations have no edges.

* * * * *